United States Patent [19]

Wigg et al.

[11] Patent Number: 4,852,766

[45] Date of Patent: Aug. 1, 1989

[54] APPARATUS FOR AUTOMATICALLY DISPENSING A LIQUID INTO A CONTAINER INCLUDING A MEMBER FOR BLOCKING ACCESS TO THE INTERIOR OF THE APPARATUS

[75] Inventors: Martin E. Wigg, Warrington; Bryan M. Peckjian, Philadelphia; Judson D. Smith, Jr., North Wales, all of Pa.

[73] Assignee: Gross-Given Manufacturing Company, St. Paul, Minn.

[21] Appl. No.: 165,861

[22] Filed: Mar. 9, 1988

[51] Int. Cl.[4] ..... A47F 1/00

[52] U.S. Cl. ..... 221/96; 222/504; 141/87

[58] Field of Search ..... 221/96, 12, 92; 222/559, 560, 504, 63, 52, 508, 544, 409, 173, 108; 141/86, 87

[56] References Cited

U.S. PATENT DOCUMENTS

| | | | |
|---|---|---|---|
| 2,325,441 | 7/1943 | Tucker et al. | 222/504 |
| 2,661,876 | 12/1953 | Kindseth | 222/504 |
| 2,729,376 | 1/1956 | Gould et al. | 221/96 |

*Primary Examiner*—Joseph J. Rolla
*Assistant Examiner*—Kenneth Noland
*Attorney, Agent, or Firm*—Panitch Schwarze Jacobs and Nadel

[57] ABSTRACT

An apparatus for automatically dispensing a liquid into a container comprises a housing containing a supply of containers, a source of liquid to be dispensed, and a container well having an opening for receiving and supporting a container during dispensing of the liquid. Containers are delivered one at a time from the container supply to the container well and the liquid is dispensed from the liquid source into a container supported in the container well. A support member is supported by the housing for pivotal movement. A blocking member is secured to the support member distal from the point at which the support member is pivotally connected to the housing for movement with the support member between an operative position and an inoperative position. The blocking member is at least slightly larger than the container well opening so that the blocking member blocks access to the interior of the housing when in the operative position. In the inoperative position, the blocking member is moved away from the container well to permit containers to be delivered to the container well and liquid to be dispensed into containers supported in the container well.

11 Claims, 2 Drawing Sheets

APPARATUS FOR AUTOMATICALLY DISPENSING A LIQUID INTO A CONTAINER INCLUDING A MEMBER FOR BLOCKING ACCESS TO THE INTERIOR OF THE APPARATUS

BACKGROUND OF THE INVENTION

The present invention relates generally to machines or apparatus for automatically dispensing a liquid into a container and, more particularly, to such an apparatus which includes a blocking member which, when in an operative position, blocks access to the interior of the apparatus.

Apparatus or vending machines for automatically dispensing a liquid into a container or cup are generally well known in the art. Machines of this type are widely employed for dispensing coffee, tea, soup and other hot drinks and/or for dispensing cold drinks, such as carbonated soft drinks, juices or the like. With some vending machines, the liquid to be dispensed is premixed, such as premixed fruit drinks. With other such machines, the liquid to be dispensed is prepared during or just prior to dispensing, such as brewing a single cup of coffee and/or combining a concentrate or syrup with an appropriate amount of carbonated water. However, all such machines have a source of the liquid to be dispensed.

Most such machines also contain a supply of the containers or cups within which the liquid is dispensed for consumption by the machine user. The cups are generally delivered one at a time from the cup supply to a container or cup well having an opening sized for receiving and supporting a cup during the dispensing of the liquid. The cup well is also generally accessible from the outside of the machine to permit a user to remove the cup for consumption of the dispensed liquid.

Since the cup well serves as an interface conduit between the interior and the exterior of the vending or dispensing machine, it is desirable to close or otherwise block off the cup well in order to prevent a person from putting his or her hand into the machine through the cup well, possibly resulting in damage to the machine and/or injury to the person's hand. It is also desirable to have the ability to provide such a closure in order to prevent or at least diminish the possibility of small animals, insects or the like from gaining access to the interior of the machine, possibly resulting in damage to the machine, loss of the product being dispensed and an unsanitary condition.

Prior art machines have generally employed a sliding door mechanism, either on the exterior of the machine or on either end of the container well, or both, in order to prevent such unauthorized access to the interior of the machine. Such sliding door mechanisms generally include a door member formed of a plastic or metal material, which is fitted within a pair of either horizontally or vertically oriented tracks. The door member may be slid along the tracks by the action of a motor, a spring or by the user sliding or lifting the door.

While such door mechanisms are generally adequate for their intended purposes, the mechanisms are relatively complex and require frequent servicing. The servicing is often the result of the liquid and/or other materials building up on the door member and/or within the tracks and preventing the door member from properly sliding or from sliding at all, thereby defeating the purpose of the door mechanism. In the case of the prior art spring operated door mechanism, the spring sometimes becomes misadjusted, resulting in the door either opening or closing too promptly, thereby causing the product to spill and/or causing injury to the user.

The present invention overcomes many such problems associated with prior art dispensing machines apparatus by providing a blocking member or door which is pivotable between an operative condition in which the blocking member overlays the container well to block access to the interior of the machine housing, and an inoperative position in which the blocking member is pivoted away from the container well to permit the containers to be delivered to the well and the liquid to be dispensed into containers within the well in the normal manner. The axis about which the door pivots is located above the level at which the liquid enters the container well, so the possibility of the dispensed liquid detrimentally affecting the pivoting of the blocking member is greatly diminished.

SUMMARY OF THE INVENTION

Briefly stated, the present invention comprises an apparatus for automatically dispensing a liquid into a container. The apparatus comprises a housing containing a supply of containers, a source of the liquid to be dispensed, and a container well having an opening for receiving and supporting a container during dispensing of the liquid. Means are included for delivering containers one at a time from the container supply to the container well. Means are also included for dispensing liquid from the liquid source into a container supported in the container well. The improvement comprises a support member supported by the housing for pivotal movement and a blocking member secured to the support member distal from the point at which the support member is pivotally connected to the housing for movement with the support member between an operative position and an inoperative position. The blocking member is at least slightly larger than the container well opening so that the blocking member blocks access to the interior of the housing via the container well when in the operative position. When in the inoperative position, the blocking member is moved away from the container well to permit containers to be delivered to the container well and liquid to be dispensed into containers supported in the container well. Means are provided for pivoting the support member to move the blocking member to the inoperative position when liquid is to be dispensed, and to the operative position upon completion of the dispensing of the liquid.

BRIEF DESCRIPTION OF THE DRAWINGS

The foregoing summary, as well as the following detailed description, will be better understood when read in conjunction with the appended drawings. For the purpose of illustrating the present invention, there is shown in the drawings an embodiment which is presently preferred, it being understood, however, that the invention is not limited to the precise arrangement and instrumentalities shown. In the drawings.

DESCRIPTION OF THE PREFERRED EMBODIMENT

Figure 1:
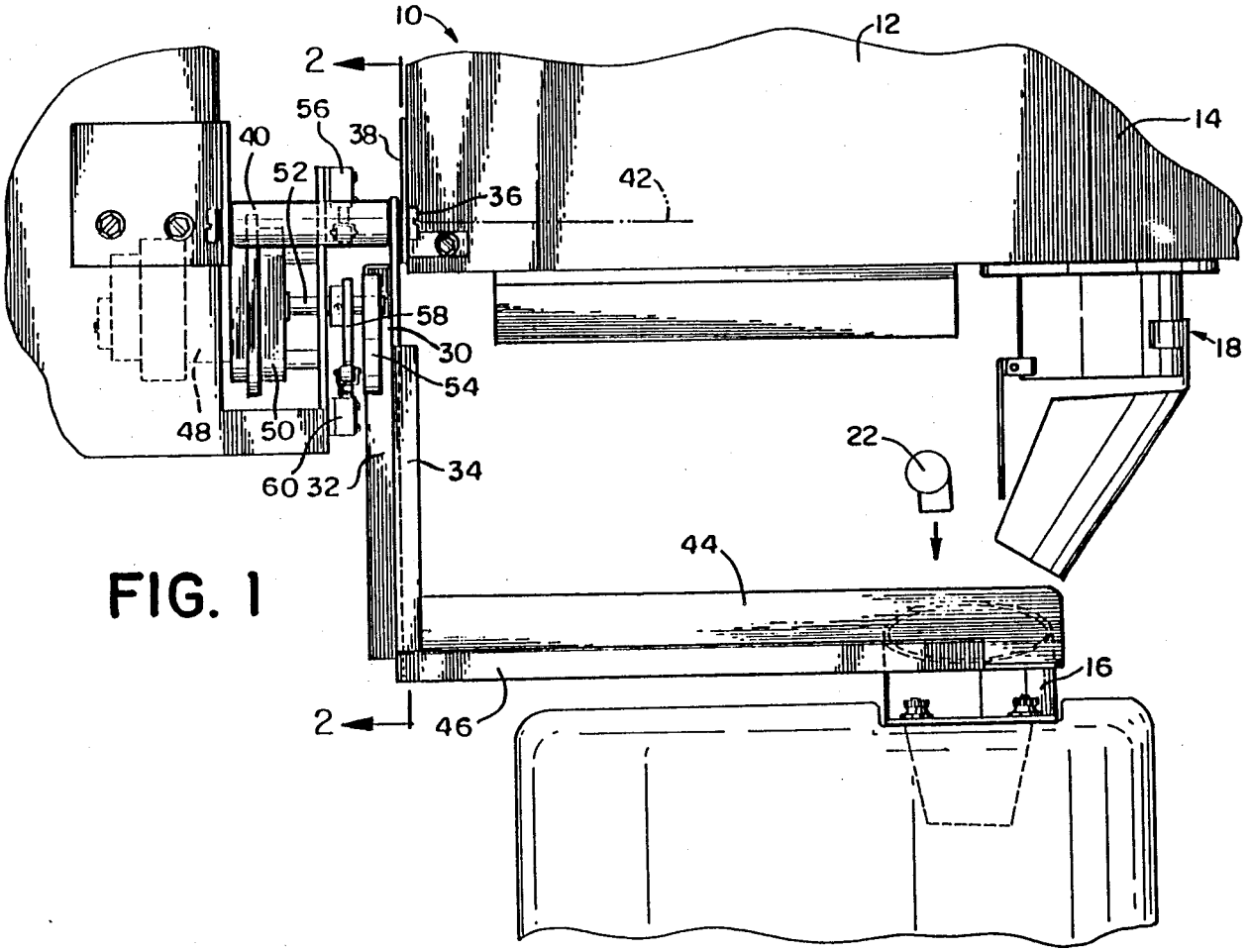
FIG. 1 is an elevational view of a portion of a dispensing machine viewed from the interior of the machine.

Referring to the drawings, wherein like numerals indicate like elements throughout, there is shown in FIG. 1 an elevational view of a portion of the interior of a vending machine or apparatus 10 for automatically dispensing a liquid into a container. Machines of this type are generally well known in the art and are employed, for example, for dispensing coffee or other hot drinks and/or soft drinks or other cold drinks. Complete details of the structure and operation of such machines are not necessary for an understanding of the present invention and will not be presented herein. Such details are available from the various vending machine manufacturers, including Gross-Given Manufacturing Company, the assignee of the present invention. In general, such machines include a generally box-like cabinet or housing 12 within which is located a supply of containers or cups 14, which are usually stored in a plurality of generally vertically extending stacks (not shown). A container well or cup well 16 is provided for receiving and supporting a cup while the liquid is being dispensed. The cup well 16 is usually located at a convenient height, which is lower than the cup supply 14. Once the liquid has been dispensed into the cup, the cup well 16 holds the liquid-filled cup until the machine user or purchaser removes the cup through an appropriate sized access opening (not shown) around the cup well 16 on the front of the machine. The machine also includes means 18 for delivering the cups or containers, one at a time from the cup supply 14 to the cup well 16. The cup supply 14, cup well 16 and cup delivery means 18 are all of a type generally well known in the dispensing machine art and commercially available.

Also contained within the machine 10 is a source of the liquid to be dispensed and means 22 for dispensing the liquid from the liquid source into a container or cup supported in the cup well 16. The liquid source could be a container holding a premixed liquid, such as a fruit juice. Alternatively, the liquid source could comprise a combination of a container of flavored syrup and a container of carbonated water which are mixed in a predetermined ratio upon being dispensed into the cup. The liquid source could alternatively comprise a mechanism for brewing a single cup of coffee, tea or the like. Details concerning the structure and operation of these and various other types of liquid sources and/or liquid dispensing means 22 employed in such dispensing machines are generally known and are available from the various manufacturers.

In the operation of such a dispensing or vending machine in its simplest form, a user generally deposits the amount of money necessary for operation of the machine and selects the desired liquid or drink by depressing the appropriate button (not shown) on the front of the machine. After the button has been depressed, the cup delivery means 18 delivers a single cup from the cup source 14 to the cup well 16. The cup well 16 supports the cup in an upright, properly aligned condition for receiving the liquid. After the cup has been delivered to the cup well 16, the liquid dispensing means 22 dispenses a predetermined quantity of the liquid from the liquid source into the cup. Of course, if the liquid is of the type which must be processed before delivery (for example, the brewing of fresh coffee), there may be a time delay between the delivery of the cup to the cup well 16 and the actual dispensing of the liquid into the cup. Once the liquid has been dispensed into the cup, the user may remove the cup from the cup well 16 and the liquid may be consumed. The machine is then ready for the dispensing of another cup of liquid.

The vending machine 10 as thus far described is typical of a prior art liquid dispensing apparatus or machine. The present invention is an improvement upon such prior art machines with respect to preventing or blocking access to the interior of the machine via the cup well 16.

The present invention comprises a support member 30, which is supported by the housing 12 for pivotal movement. In the present embodiment, the support member 30 is generally flat with a first generally perpendicularly extending flange member or lip 32 on one side and a second generally perpendicularly extending flange 34 on the opposite side. In the present preferred embodiment, the support member 30 is formed of a metallic material such as cold rolled steel. However, it will be appreciated by those skilled in the art that the support member 30 could be formed of any other suitable material, such as a plastic material.

In the presently preferred embodiment, the upper end of the support member 30 is pivotally secured to the housing 12, utilizing a bolt or screw 36 which extends through a suitably sized opening (not shown) in the upper end of the support member 30. The upper end of the support member 30 is installed between a generally flat, vertically extending flange member 38, which is secured to the housing 12, an attachment member 40, also secured to the housing 12, and having a threaded opening (not shown) therein. The bolt 36 extends through a suitably sized opening in the flange member 38, through the opening in the upper end of the support member 30 and is threadingly engaged within the opening in the attachment member 40. The spacing between the flange member 38 and the attachment member 40 in combination with the size of the circular opening in the support member 30 permits the support member 30 to freely pivot or rotate about the bolt 36, thereby establishing a pivot axis 42 for the support member 30 which is generally coaxial with the bolt 36. It will be appreciated that while the above-described structure is presently preferred, the support member 30 could alternatively be supported in any other suitable manner which allows for similar pivotal or rotational movement of the support member 30 with respect to the housing 12 in a manner which will hereinafter become apparent.

In the presently preferred embodiment, the support member 30 is generally shaped like a right triangle in side elevation (see FIG. 2*a*), with the pivot point or pivot axis 42 being located near the intersection of the height and the hypotenuse. Of course, it will be appreciated by those skilled in the art that the support member 30 could be formed into any other suitable shape, if desired.

Figure 2A:
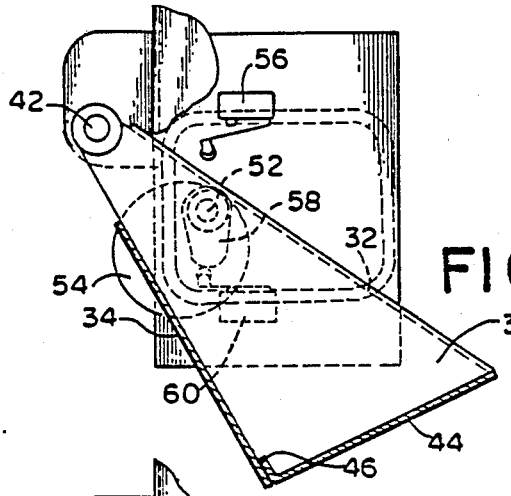
FIGS. 2*a* through 2*c* are sectional views taken along the line 2—2 of FIG. 1 and showing the blocking member in its operative position (FIG. 2*a*), moving between its operative position and its inoperative position (FIG. 2*b*) and in its inoperative position (FIG. 2*c*).

A cover member or blocking member 44 is secured to the support member 30 distal from the point at which the support member 30 is pivotally connected to the housing 12. In the embodiment shown, the blocking member 44 is secured to the portion of the support member 30 which would be equivalent to the base of the triangle when viewed in side elevation (FIG. 2*a*). In the presently preferred embodiment, the blocking member 44 is made of the same material as the support member 30. However, the blocking member 44 could be formed of any other suitable material, such as plastic.

In the presently preferred embodiment, the blocking member 44 is flat, generally rectangular in plan view, and extends generally perpendicularly outwardly from the bottom end of the support member 30. The blocking member 44 includes a flange member or lip 46, which extends generally perpendicularly outwardly and correspondingly to the second flange member 34 of the support member 30.

Figure 2B:
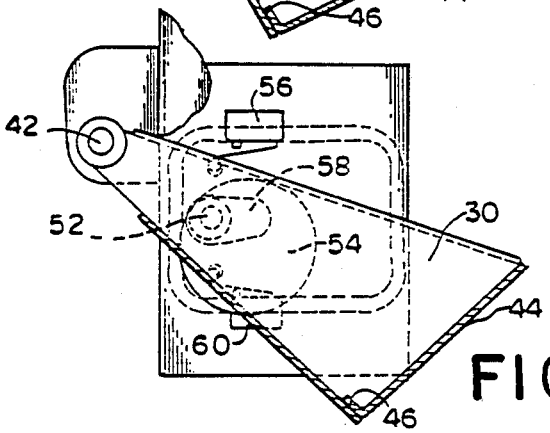
Figure 2C:
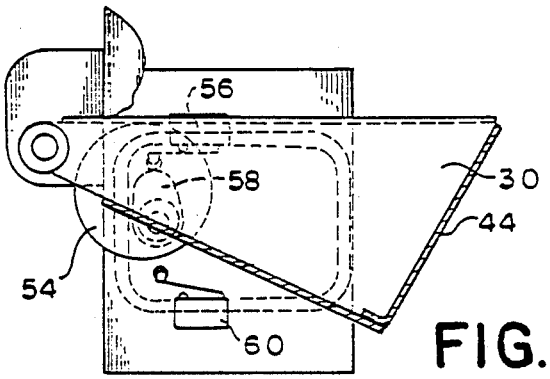

The blocking member 44 pivots or moves with the support member 30 between an operative position shown in FIGS. 1 and 2*a* and an inoperative position shown in FIG. 2*c*. The blocking member 44 is at least slightly larger than the opening in the cup well 16, so that the blocking member 44 generally overlays and closingly engages the upper surface of the cup well 16 when in the operative position. In this manner, when in the operative position, the blocking member 44 blocks access to the interior of the housing 12 via the cup well 16. When the blocking member 44 is in the inoperative position, it is completely disengaged from and is moved away from the cup well 16 to permit cups to be delivered into the cup well 16 and to permit liquid to be dispensed into cups supported in the cup well 16 in the usual manner well known in the dispensing machine art.

As best shown in FIG. 1, the pivot axis 42 for the support member 30 and the blocking member 44 extends generally horizontally and is at an elevation which is above the elevation of the cup well 16 and above the level at which the liquid is dispensed into the cup well 16. In this manner, it is unlikely that liquid being dispensed to a cup within the cup well 16 could splash on or build up upon the upper end of the support member 30 and/or the supporting bolt 36, thereby making it unlikely that the dispensing of the liquid could detrimentally affect the pivoting of the support member 30 and blocking member 44. In addition, as best shown in FIGS. 2*a* through 2*c*, the pivot axis 42 does not directly overlie any portion of the cup well 16. Instead, the axis 42 is located on one side of the cup well 16 and the blocking member 44 moves upwardly on the other side of the cup well 16.

The invention further comprises means for pivoting the support member 30 to move the blocking member 44 to the inoperative position when liquid is to be dispensed, and to the operative position upon completion of the dispensing of the liquid. In the present embodiment, the means for pivoting the support member 30 and the blocking member 44 is comprised of a motor, shown in phantom as 48, which is secured to the housing 12. The motor 48, which preferably is an electrically actuated shaded pole motor, has associated gearing 50 with an output shaft 52 which, in the present embodiment, rotates at about 18 revolutions per minute. As best seen in FIG. 1, the output shaft 52 is generally parallel to the pivot axis 42 of the support member 30 and blocking member 44.

A cam member 54 is secured to the output shaft 52 for rotation therewith. In the present embodiment, the cam member 54 is of the eccentric type and is preferably made of a low abrasive plastic material, such as DELRIN. It will be appreciated by those skilled in the art that the cam member 54 could be of some other type, or could be formed of some other suitable material, such as TEFLON, or the like The cam member 54 is secured to the output shaft 52 in alignment with the flange member 32 of support member 30 at a position between the pivot axis 42 and the blocking member 54. A demonstrated by FIGS. 2*a* through 2*c*, as the output shaft 52 and cam member 54 rotate in a counterclockwise direction, the cam member 54 engages flange member 32 and urges the support member 30 to pivot upwardly about the pivot axis 42, thereby moving the blocking member 44 from the operative position of FIG. 2*a* to the inoperative position of FIG. 2*c*. As will be appreciated by those skilled in the art, as the cam member 54 continues to rotate in the counterclockwise direction beyond the position shown in FIG. 2*c* the cam member 54 permits the support member 30 to pivot downwardly in the opposite direction due to the weight of the support member 30 and blocking member 44 to thereby move the blocking member 44 to the operative position, as shown in FIG. 2*a*.

The invention further comprises means for activating the motor 48 at predetermined times for rotation of the cam member 54. When the machine 10 is not engaged in dispensing liquids, the blocking member 44 is in the operative position shown in FIGS. 1 and 2*a*. When a user depresses a selection button (not shown) on the front of the machine, electrical energy is supplied to activate the motor 48 to rotate cam member 54. As previously described, activation of the motor 48 results in the blocking member 44 pivoting upwardly, as shown in FIG. 2*b*. Means are provided for deactivating the motor 48 when the blocking member 44 moves to the inoperative position, as shown in FIG. 2*c*. In the present embodiment, the deactivating means comprises a first electrical switch 56 secured to the housing 12 generally above the output shaft 52. An engaging member 58 is also secured to the output shaft 52 for rotation therewith. The engaging member 58, which extends generally radially outwardly from the output shaft 52, is aligned with the first switch 56, as shown in FIG. 1. Rotation of the output shaft 52 results in corresponding rotation of the engaging member 58. As the blocking member 44 pivots to its inoperative position (FIG. 2*c*), the engaging member 58 engages and actuates the first switch 56. Actuation of the first switch 56 deactivates the motor 48, thereby maintaining the cam member 54 in the upward position, as shown in FIG. 2*c*, to hold the blocking member 44 in the inoperative position.

As previously discussed, when the blocking member 44 is in the inoperative position, a cup may be delivered to the cup well 16 and liquid from the liquid source may be dispensed by the liquid dispensing means 22 into the cup within the cup well 16. When the correct amount of liquid has been dispensed, the liquid dispensing means 22 is deactivated, resulting in activation of the motor 48. As previously described, activation of the motor 48 results in the cam member 54 rotating counterclockwise beyond the position shown in FIG. 2*c* and correspondingly results in the blocking member 44 pivoting downwardly. A second electrical switch 60 is secured to the housing 12 at a position generally beneath the output shaft 52 and in alignment with the engaging member 58. When the output shaft 52 and the cam member 54 reach the point at which the blocking member 44 is in its operative position (FIG. 2*a*), the engaging member 58 engages and actuates the second switch 60 to deactivate the motor 48, thereby leaving the blocking member 44 in its operative position.

The switches 56 and 60 are both of a type generally well known for controlling the activation and/or deactivation of motors and other equipment in the dispensing machine art. It will be appreciated by those skilled in the art that means, other than the means described above, may alternatively be employed for both activating and deactivating the motor 48. Likewise, different types of switches and/or a different engaging member may be employed for this purpose. It will also be appreciated by those skilled in the art that means, other than the electric motor 48 and cam member 54, may alternatively be employed for pivoting the support member 30 and blocking member 44. For example, a pneumatic motor may be employed instead of the electric motor 48. Similarly, a spring actuated solenoid (not shown) may be employed instead of the combination of the motor 48 and cam member 54.

From the foregoing description, it can be seen that the present invention comprises an apparatus for automatically dispensing a liquid, which includes a pivotable blocking member for movement between an operative position for blocking access to the interior of the machine housing and an inoperative position. It will be recognized by those skilled in the art that changes may be made to the above-described embodiment of the invention without departing from the broad inventive concepts thereof. It is understood, therefore, that this invention is not limited to the particular embodiment disclosed, but it is intended to cover all modifications which are within the scope and spirit of the invention, as defined by the appended claims.

We claim:

1. In an apparatus for automatically dispensing a liquid into a container comprising: a housing containing a supply of containers, a source of the liquid to be dispensed, and a container well having an opening for receiving and supporting a container during dispensing of the liquid; means for delivering containers one at a time from the container supply to the container well; and means for dispensing liquid from the liquid source into a container supported in the container supply to the container well; and means for dispensing liquid from the liquid source into a container supported in the container well, the improvement comprising:

a support member supported by the housing for pivotal movement;

a blocking member secured to the support member distal from the point at which the support member is pivotally connected to the housing for movement with the support member between an operative position and an inoperative position, the blocking member being at least slightly larger than the container well opening so that the blocking member engages and closes the container well and completely blocks access to the interior of the housing via the container well when in the operative position, the blocking member being moved away from the container well to permit containers to be delivered to the container well and liquid to be dispensed into container supported in the container well when in the inoperative position; and means for pivoting the support member to move the blocking member to the inoperative position when liquid is to be dispensed and to the operative position upon completion of the dispensing of the liquid.

2. The apparatus as recited in claim 1, wherein the blocking member is generally flat and generally overlays and closingly engages an upper surface of the container well when in the operative position.

3. The apparatus as recited in claim 1, wherein the support member pivots about an axis, the axis being generally horizontal.

4. The apparatus as recited in claim 3, wherein the axis is located at an elevation above the elevation of the container well and above the elevation at which the liquid is dispensed into the container well.

5. The apparatus as recited in claim 3, wherein the axis is at an elevation which is above the elevation of the container well, but the axis does not overlay the container well.

6. The apparatus as recited in claim 1, wherein the support member pivots in one direction for moving the blocking member from the operative position to the inoperative position and wherein the support member pivots in the opposite direction for moving the blocking member from the inoperative position to the operative position.

7. In an apparatus for automatically dispensing a liquid into a container comprising: a housing containing a supply of containers, a source of a liquid to be dispensed, and a container well having an opening for receiving and supporting a container during dispensing of the liquid; means for delivering containers one at a time from the container supply to the container well; and means for dispensing liquid from the liquid source into a container supported in the container well, the improvement comprising:

a support member supported by the housing for pivotal movement;

a blocking member secured to the support member distal from the point at which the support member is pivotally connected to the housing for movement with the support member between an operative position and an inoperative position, the blocking member being at least slightly larger than the container well opening so that the blocking member blocks access to the interior of the housing via the container well when in the operative position, the blocking member being moved away from the container well to permit containers to be delivered to the container well and liquid to be dispensed into containers supported in the container well when in the inoperative position; and means for pivoting the support member to move the blocking member to the inoperative position when liquid is to be dispensed and to the operative position upon completion of the dispensing of the liquid, the means comprising a motor having an output shaft, a cam member secured to the shaft, the cam member engaging the support member for pivotal movement of the support member, and means for activating the motor at predetermined times for rotation of the cam member.

8. The apparatus as recited in claim 7, wherein the cam member is of the eccentric type.

9. The apparatus as recited in claim 8, wherein the cam member engages the support member for pivotal movement of the support member in one direction for moving the blocking member from the operative position to the inoperative position, the inoperative position of the blocking member being at a height greater than the operative position of the blocking member, and whereby the cam member permits the support member to pivot in the opposite direction for movement of the support member from the inoperative position to the operative position.

10. The apparatus as recited in claim 7, wherein the cam member engages the support member between the point at which the support member is pivotally connected to the housing and the point at which the blocking member is secured to the support member.

11. The apparatus as recited in claim 7, wherein the means for pivoting the support member further comprises means for deactivating the motor when the blocking member is in the operative position and the inoperative position.

* * * * *